United States Patent [19]

Kasbohm

[11] Patent Number: 4,629,117

[45] Date of Patent: Dec. 16, 1986

[54] HEAT RECOVERY SYSTEM

[76] Inventor: Martin L. Kasbohm, 149 Fleetwood Ter., Williamsville, N.Y. 14221

[21] Appl. No.: 646,778

[22] Filed: Sep. 4, 1984

[51] Int. Cl.[4] ..... F24B 7/00

[52] U.S. Cl. ..... 237/55; 126/110 R; 165/901

[58] Field of Search ..... 237/55, 50, 53; 165/DIG. 2, 901; 126/99 R, 110 R, 110 A

[56] References Cited

U.S. PATENT DOCUMENTS

| | | | |
|---|---|---|---|
| 1,573,406 | 2/1926 | Lewis | 237/55 X |
| 4,044,950 | 8/1977 | Engeling et al. | 237/55 |
| 4,079,888 | 3/1978 | Briscoe | 237/55 |

FOREIGN PATENT DOCUMENTS

| | | | |
|---|---|---|---|
| 27395 | 2/1932 | Netherlands | 237/53 |

*Primary Examiner*—Henry Bennett
*Attorney, Agent, or Firm*—James J. Ralabate

[57] ABSTRACT

A retrofit heat recovery device for installation on existing hot air furnaces. The device is arranged to make use of the existing hot pin furnace blower.

6 Claims, 4 Drawing Figures

HEAT RECOVERY SYSTEM

This invention generally relates to heating equipment and, more specifically, to an economical structure and method for converting less efficient hot air furnaces to more efficient systems.

BACKGROUND OF THE INVENTION

Many hot air furnaces installed in homes or commercial structures in the past are only about 50–70% efficient. This is understandable since 15 or 20 years ago fuel costs were not a major concern and the furnaces sold reflected overall cost considerations of equipment and fuel. Today, the outlook has changed considerably—fuel costs have skyrocketed and fuel has become a depreciating commodity. With all fuels becoming limited, there is a pressing need to consume them at as high an efficiency rate as is possible given reasonable investment costs. To increase the efficiency of existing furnaces a retrofit system must be developed that provides low installed cost and low maintenance.

A hot air furnace is a structure commonly used today in homes. It transfers heat from the furnace to the room space by using circulating air as the heat transfer medium. The furnace can be fired by any fuel; however, the common fuels are either gas or oil. When the thermostat in the room space calls for heat, the burner in the furnace fires. When the heat exchanger reaches a minimum set temperature a thermal switch in the furnace turns on a blower which causes air to flow through the furnace heat exchanger into a hot air duct connected to the room space. Another duct returns air from the room space to the inlet of the blower. When the heat exchanger in the furnace reaches a maximum set temperature, the furnace thermal switch shuts off the burner. When the circulating air cools the heat exchanger back into its set operating range, the thermal switch refires the burner. When the room thermostat calls for a cessation of heating, the burner shuts off. When the furnace heat exchanger cools to the lower set temperature of the thermal switch, the blower shuts off. The present invention can be added to the hot air furnace without any change in the operating cycle described above.

Most existing hot air furnaces have low efficiency for conversion of the energy in the fuel to heat in the room space. Some local gas utilities find that conventional gas furnaces have a seasonal efficiency level in the range of 60–65%. New furnaces are available that have a level of 90–95%, but are considerably more expensive than conventional furnaces. The conventional furnaces were designed and sold when fuel was relatively low cost and when the cost of high-efficiency furnaces could not be justified. The conventional furnaces have limited heat transfer area in the furnace heat exchanger for cooling the combustion gases and they do not have a countercurrent flow arrangement between the flue gases and the circulating air. The present invention serves to correct both deficiencies by adding heat transfer area and by having the flue gases and the air in countercurrent heat exchange. This is done in a simple manner without the addition of blowers or controls so that the system can be easily applied to the very large number of existing furnaces.

The present invention can bring the furnace efficiency level from 60–65% to 80–85%. To raise the efficiency level higher would require condensing the moisture in the flue gas and would make the unit much more complex and costly. The estimated installed cost of the present invention is such that the fuel savings will pay for the unit in a very short period of time—even less than one year.

There have been many attempts to provide usable systems for flue gas heat recovery but as yet none that have both efficiency and are economical have been commercially acceptable. A system presently in limited use provides a simple heat exchanger in the flue pipe with a blower to pass air through the heat exchanger to recover some heat from the flue gas and to heat the area adjacent to the furnace. This system has low efficiency for heat recovery but has been used because of its simplicity and low costs. Other systems are described in U.S. Pat. Nos. 3,934,798; 4,122,999; 4,147,303; 4,308,990; 4,392,610; 4,408,716; and 4,418,866. In U.S. Pat. No. 3,934,798 a heat recovery system for hot air furnaces is described that has a heat exchanger installed in the flue gas line; however, it requires a separate duct from a room register and the system dumps the recovered heat into the cold air duct where it will cause a reduction in the heat transfer of the main furnace heat exchanger. The heat exchanger cannot tolerate any leakage since the air is at a slightly lower pressure than the flue gas. In U.S. Pat. No. 4,122,999 a forced air heating system is described that involves the installation and use of heat exchangers in the both the hot and cold air ducts of the furnace. A system such as this prior art structure requires integral heat exchangers and is not useful in retrofitting or converting existing low efficiency furnaces. U.S. Pat. Nos. 4,147,303 and 4,308,990 define a complex system that utilizes a heat-saving attachment that requires an added blower for air flow, requires ducts for heated and return air, and requires additional controls for the blower circuit. In U.S. Pat. Nos. 4,408,716 and 4,392,610, two added heat exchangers are required in their heat recovery systems since the recovered heat is transferred twice, i.e. flue gas to fluid and fluid to circulating air. In addition, the system described in these patents requires a fluid pump and requires controls for the hydraulic circuit. In U.S. Pat. No. 4,418,866 a heat recovery method is disclosed that takes air from the hot air duct of the furnace to exchange heat with flue gas at the elevated temperature of the hot air duct. Also, the method described in the patent requires a separate duct to move the heated air to the room space and requires a built in secondary heat exchange designed as an integral part of the furnace. Thus, none of the prior art patents disclose a heat recovery method, structure or system that is economical in installation and maintenance, substantially efficient and can be conveniently applied broadly to most existing furnaces.

SUMMARY OF THE INVENTION

It is, therefore, an object of this invention to provide a hot air furnace heat recovery system devoid of the above-noted disadvantages.

Another object of this invention is to provide a hot air furnace retrofit that is economical and can be applied broadly to existing furnaces.

A further object of this invention is to provide a heat recovery system that is relatively efficient and yet is low in both cost of installation and maintenance.

Yet another object of this invention is to provide a heat recovery system that is easy to install and does not require expensive gas-tight heat exchanger units.

Still another object of this invention is to provide a heat recovery retrofit that uses existing equipment and does not require controls other than those already on the hot air furnace.

Yet a further object of this invention is to provide a heat recovery-flue gas system wherein no additional controls, pumps or blowers are required and wherein air is taken from the existing blower outlet.

Still a further object of this invention is to provide a retrofit unit that requires no additional ducts and wherein the recovered heated air goes directly to the existing hot air duct.

The foregoing objects and others are accomplished by this invention by providing a heat recovery system, structure and method wherein a side stream of about 20% of the air from the exhaust side of the furnace blower is taken and passed in countercurrent heat exchange with the flue gas from the furnace. The air from this heat exchange is passed into the hot air duct from the furnace where it joins the hot air that is at a similar elevated temperature. About 75% of the waste-sensible heat in the flue gas is recovered and transferred to the hot air circuit. No water vapor in the flue gas is condensed, thus corrosion is avoided. The temperatures and gas conditions permit the use of galvanized sheet metal for the heat exchanger and connecting piping. The heat exchanger does not require gas-tight seals since the flue gas is at slightly lower pressure than the air. No blower or controls other than those already on the hot air furnace are required. The system is designed and installed with proper flow control. In operation the system has no moving parts requiring maintenance other than normal hot air furnace maintenance. The above considerations provide a system that is low in both cost and maintenance.

There have been other proposed systems for flue gas heat recovery but no system to date has been sufficiently economical to be applied broadly to existing furnaces. The system of this invention can be applied broadly since, when installed, it will return its investment in less than one year through fuel savings.

The fabrication and installation of the retrofit heat recovery system can be made with standard stove pipe and fittings and galvanized sheet metal to provide a low cost installation. The temperatures, pressures and conditions of the gas streams make the above approach practical.

The present invention uses about 20% of the air flow from the furnace blower to cool the flue gas. This flow rate causes the heated air from the flue gas heat exchanger to be at about the same temperature as that of the hot air in the duct from the furnace (140° to 180° F). If the flow were reduced to one half this rate or 10% of the blower air, the heated air would be above 200° F. and the heat recovery system would operate at about 10% less efficiency. If the flow were doubled to about 40% of the furnace blower air, the primary heat exchanger in the furnace would operate less efficiently and the added load on the heat recovery unit would cause the overall system to lose performance. For maximum performance a balance is needed between the primary heat exchanger in the furnace and the heat exchanger in the heat recovery unit.

The system of this invention takes air from the exspecial heat exchanger is required that has very low pressure drop and yet has high thermal efficiency. Heat exchange between two fluids is most efficient (maximum transfer of heat for a given temperature difference between the fluids and for a given area of heat transfer surface) when it is countercurrent. To be countercurrent, one fluid flows over one side of the heat transfer surface in one direction and the other fluid flows over the other side of the heat transfer surface in the opposite direction. With this arrangement, the maximum overall temperature difference (driving force for heat transfer) is maintained between the fluids. This arrangement also permits the hot fluid to be cooled to a temperature that is often below that of the exiting heated fluid. To be countercurrent, the heat exchanger must be designed to control the fluid flows as discussed above. Heat exchangers in most furnaces are not designed for countercurrent heat exchange.

For this invention, a separating plate-type heat exchanger is used. The plate in the heat exchanger is folded to provide a compact unit with large surface area. The heat exchanger has low pressure drop for the gas streams and yet has high performance for heat transfer.

While a heat exchanger designed for low pressure drop and countercurrent heat exchange is preferred, any suitable heat exchanger may be used. Standard heat exchangers available today are as follows:

Shell and Tube

Shell and tube is the most common type of heat exchanger. A bundle of tubes is installed between tube sheets and mounted in a shell. One fluid flows through the tubes and the other fluid flows through the shell and is directed by baffles to flow back and forth across the tubes. The tubes can have fins for added heat transfer.

Plate and Fin

Plate and fin heat exchangers are made by stacking metal sheets separated by fins and brazing the very large multilayer sandwich into one heat exchanger. The passages between the sheets are headered such that the fluids exchanging heat pass through alternate passages.

Regenerative Heat Exchange

Regenerators are heat storage devices that operate in pairs, wherein heat from one fluid is transferred to one regenerator while the other fluid is receiving heat from the other regenerator. The flows are periodically switched to provide an overall transfer of heat between the two fluid streams.

Figure 1:
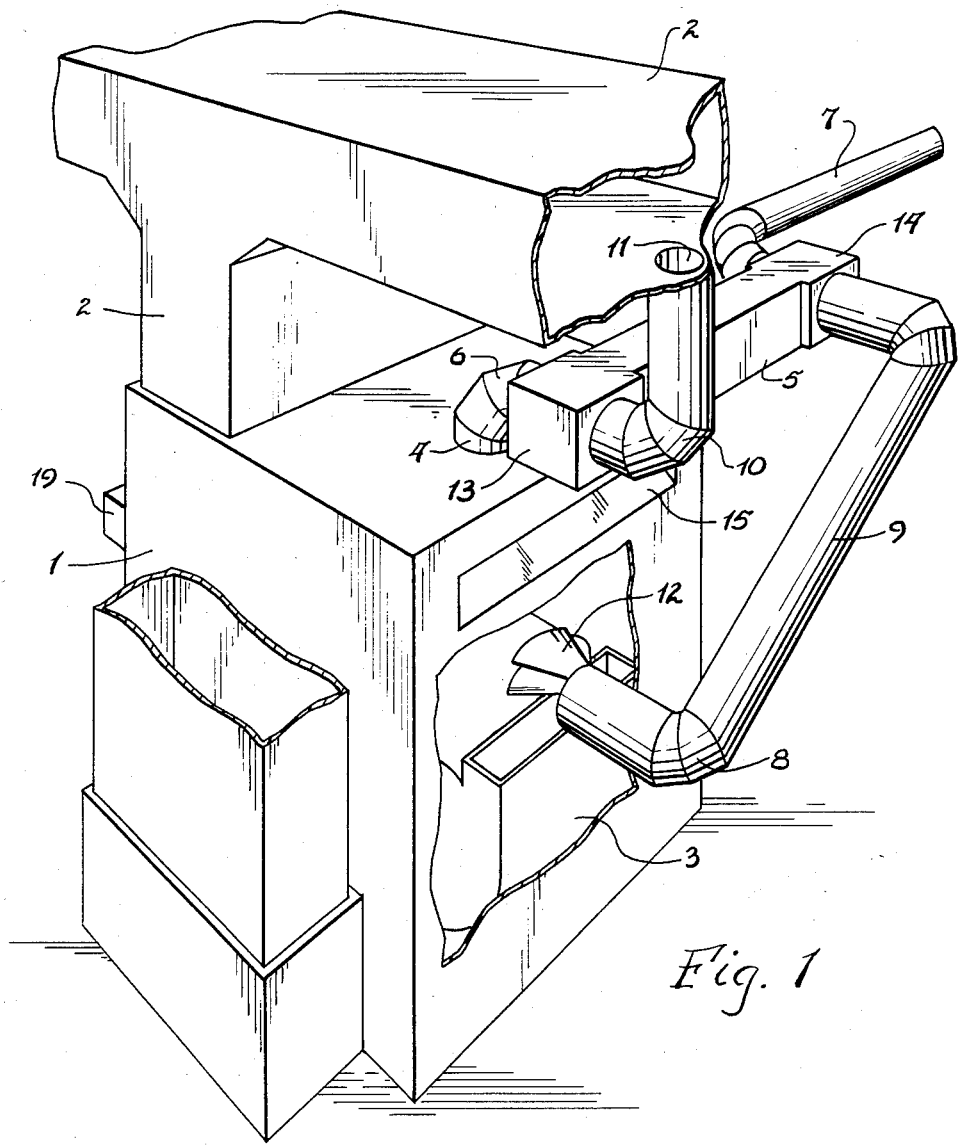
FIG. 1 is a perspective view of the heating system after the retrofit of this invention.

DESCRIPTION OF THE DRAWING AND OF THE PREFERRED EMBODIMENTS shown that provides the conduit through which heated air is passed from furnace 1 to the room space to be heated. An air blower location 3 of conventional construction and design is positioned in the bottom portion of furnace 1. Flue gas outlet 4 is modified by adding the retrofit of this invention which comprises a heat exchanger 5 and appropriate pipes positioned from heat exchanger 5 to critical portions of the heating system. Hot flue gas from the furnace passes through flue gas outlet 4 and pipe 6 into the hot end 13 of the heat exchanger 5. The cooled flue gas from the cool end 14 of heat exchanger 5 is connected and transmitted to the chimney by a pipe 7. To provide countercurrent heat exchange between the flue gas and blower air, a pipe 8 is tapped through the wall of the furnace, just above the blower 3 outlet, and this pipe is connected by additional pipe 9 to the cool end 14 of heat exchanger 5. The warmed air from the hot end 13 of the heat exchanger 5 is passed to the hot air duct 2 of the furnace 1 by the pipe 10 which is connected between the heat exchanger 5 and a pipe 11 which is tapped into the hot air duct 2. An adjustable air scoop 12 is connected to the air pipe 8 on the inside of the furnace. This air scoop 12 converts some of the kinetic energy of the blower air stream into a pressure head for flow of air through the heat exchanger 5. When the overall system of heat recovery is installed, the air scoop 12 is set to control the air flow so that the heat exchanger air exit temperature is similar to the air temperature in the hot air duct 2. The flue gas leaving the exchanger 5 is well above the water condensation temperature, thus economical materials without concern for condensation may be used throughout. Back draft diverter 15 is shown as part of furnace 1; however, it may be positioned in the flue gas pipe.

Figure 2:
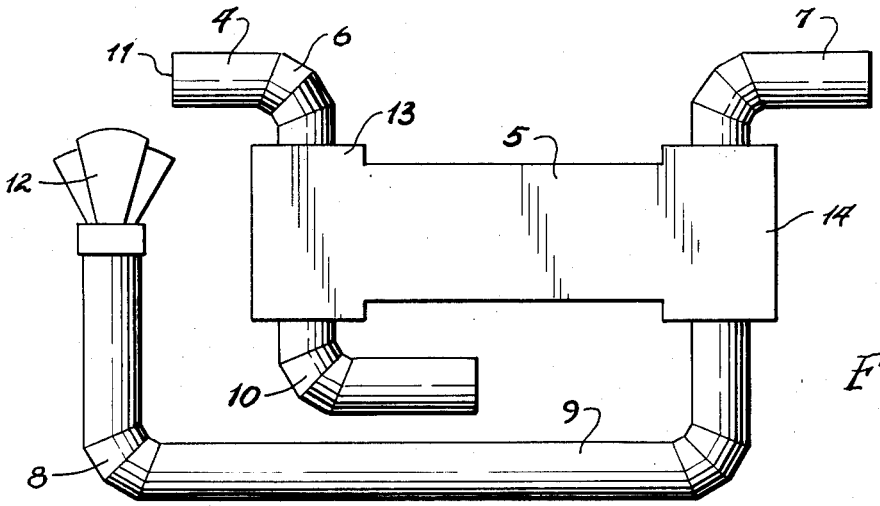
FIG. 2 is a perspective view of the heat recovery retrofit of this invention.

In FIG. 2, the retrofit portion used to convert the furnace 1 to a higher efficiency unit is shown. This retrofit portion comprises a heat exchanger 5 wherein the cool end 14 is connected to the blower outlet at a point just above the blower location 3. A pipe 9 extends downwardly to a pipe 8, said pipe attached to an air scoop 12 which is inside furnace 1. Thus, the blower supplies an air stream captured by scoop 12 which provides air flow through heat exchanger 5. Hot flue gas from the furnace 1 passes through pipes 4 and 6 into the hot end 13 of heat exchanger 5. This flue gas passes through heat exchanger 5 in countercurrent flow with the air entering the system from pipe 9 at cool end 14. The resulting heated air is passed from hot end 13 through pipe 10 to air duct 2. The entire unit is easily attached to the conventional furnace by mounting the heat exchanger near the flue gas pipe and making the gas stream connections by using standard stove pipe. The flue gas pipe is interrupted to attach to the inlet and outlet of the heat exchanger 5. The air flow is arranged by tapping stove pipe nipples through the furnace wall and hot air duct.

The retrofit unit shown in FIG. 2 is readily adapted to be connected to any conventional hot air furnace. The heat exchanger 5 should preferably be adapted to permit counterflow between hot and cool fluids. The connecting means 4 and 6 permit hot flue gas to pass from the flue or adjacent the flue to hot end 13. Air scoop 12 captures air from blower exhaust and transmits it through pipes or connecting means 8 and 9 to cool end 14 of the heat exchanger 5. It then is passed through the heat exchanger 5 and heated air exiting the hot end 13 passes through pipe or connecting means 10 to hot air duct 2. The flue gas exiting the cool end 14 of heat exchanger 5 is passed out the system through a chimney or other exhaust means.

Figure 3:
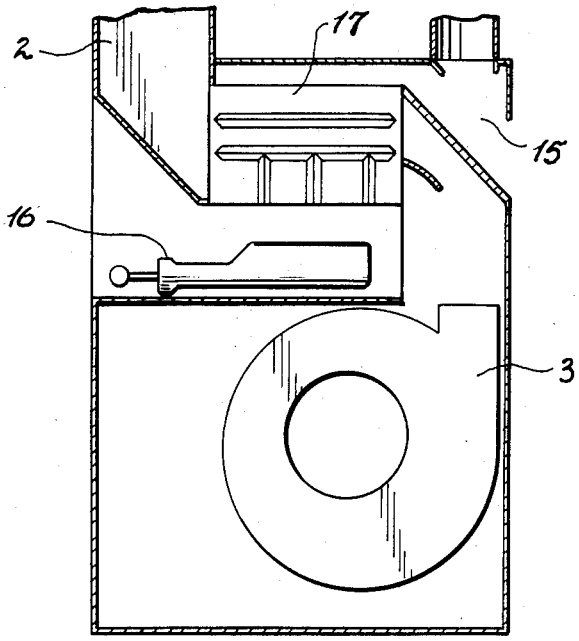
FIG. 3 is a perspective view of a conventional hot air furnace.

In FIG. 3, the components of a conventional hot air furnace are shown. The burner 16 produces hot flue gas that passes up through the inside of the finned passages of the furnace heat exchanger 17. The partially cooled flue gas then exits the furnace via the back draft diverter 15. Air returned from the room space through a cold air duct enters the blower 3 and is forced across the outside of the heat exchanger passages where it is heated. The heated air passes into the hot air duct 2 and is returned to the room space.

Figure 4:
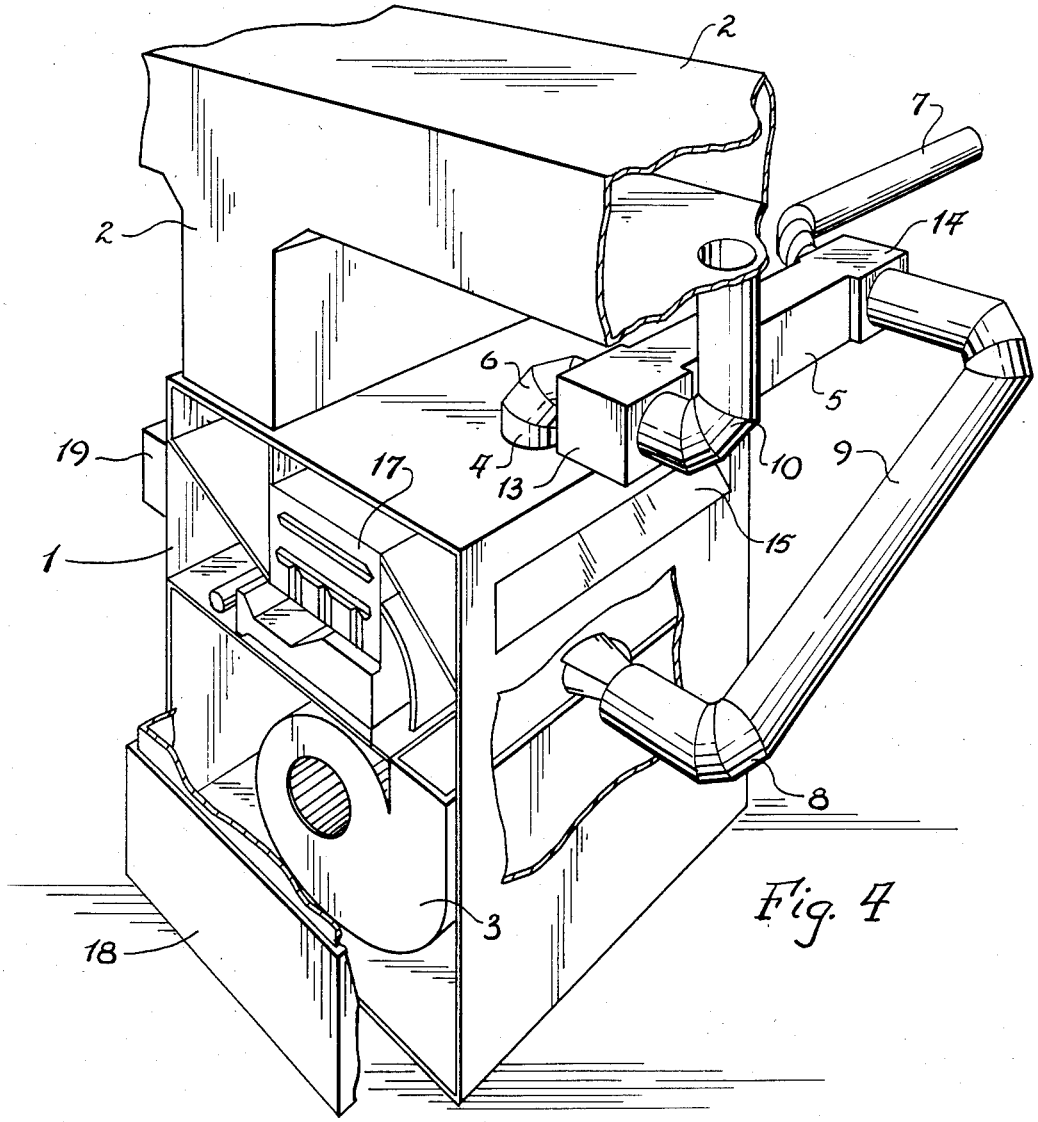
FIG. 4 is a detailed perspective of the heating system provided by this invention.

FIG. 4 is a perspective view showing in detail the components of a conventional hot air furnace and the components of the retrofit of this invention.

The conventional hot air furnace provides all of the basic components such as burner 16, heat exchanger 17, blower 3, cold air duct 20, hot air duct 2, controls 21, and back draft diverter 22. In operation, the burner 16 produces hot flue gas that is partially cooled (300°-600° F.) as it passes up through heat exchanger 17. The partially cooled flue gas flows through the back draft diverter 22 to the hot end 13 of the retrofit heat exchanger 5 via stove pipe 4 and is cooled further (140°-170° F.). The cooled flue gas exits the cold end 14 of the retrofit heat exchanger 5 and passes via pipe 7 to the chimney. The furnace blower 3 receives air from the cold air duct 20 and forces it across the original furnace heat exchanger 17 where it is heated and passed to the hot air duct 2. With the retrofit system of this invention, about 20% of the blower air is diverted and flows through the stove pipe 9 to the cold end 14 of the retrofit heat exchanger. In passing through the exchanger 5, this air is heated and exits from the hot end 13 of the heat exchanger 5 passing via pipe 10 to the hot air duct 2 of the furnace. All of the above operation is controlled by the existing controls 21 of the hot air furnace.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A retrofit unit for attachment to a hot air furnace system wherein said unit containing system comprises a fuel-burning hot air furnace with an air blower, a hot air duct, a cold air duct, a pipe for exhausting flue gas to the atmosphere and said retrofit unit, said retrofit unit comprising a gas to gas heat exchanger with low pressure drop and said heat exchanger having means connecting one side of said heat exchanger between said furnace flue gas outlet and the flue gas exhaust pipe so that substantially all of the flue gas passes through said heat exchanger and means connecting the other side of the heat exchanger between the outlet of the furnace air blower and the hot air duct to provide that between about 15 and 30% of the blower discharge air passes through said heat exchanger, said retrofit unit adapted to function in combination with said existing air blower in said system.

2. The retrofit unit of claim 1 wherein said conduit adjacent the furnace blower exhaust comprises an air scoop adapted to capture a portion of the air flow exhausted from said blower.

3. The retrofit of claim 1 including means for connecting the cool end of said heat exchanger to a chimney or exhaust system.

4. The retrofit of claim 1 wherein said means for passing heated air to the hot air plenum is adapted to extend from the hot end of said heat exchanger to said hot air plenum, and including means for connecting the cool end of said heat exchanger to a chimney which is in gas flow connection to said furnace.

5. The retrofit of claim 1 wherein said means for passing heated air to the hot air plenum is adapted to extend from the hot end of said heat exchanger to said hot air plenum, and including means for connecting the cool end of said heat exchanger to a chimney which is in gas flow connection to said furnace.

6. The retrofit of claim 1 wherein about 20% of the blower discharge air passes through said heat exchanger, and wherein this air is passed through said heat exchanger in countercurrent heat exchange with a hot flue gas.

* * * * *